United States Patent [19]

Nakamura et al.

[11] Patent Number: 4,746,325

[45] Date of Patent: May 24, 1988

[54] PROCESS FOR PRODUCING COAL-WATER SLURRY AT HIGH CONCENTRATION

[75] Inventors: Yoshinobu Nakamura, Funabashi; Tadao Goto, Chiba; Isao Fujikura; Yazaemon Morita, both of Tokyo; Shinichi Okada; Masao Inagaki, both of Chiba, all of Japan

[73] Assignees: Fuji Oil Co., Ltd.; Toho Chemical Industry Co., Ltd., both of Tokyo, Japan

[21] Appl. No.: 886,622

[22] Filed: Jul. 18, 1986

[30] Foreign Application Priority Data

Jul. 23, 1985 [JP] Japan ..... 60-163234

[51] Int. Cl.[4] ..... C10L 1/32

[52] U.S. Cl. ..... 44/51; 252/312; 252/315.1; 252/353

[58] Field of Search ..... 44/51; 252/312, 315.1, 252/353; 260/503, 504, 505 C, 505 N

[56] References Cited

U.S. PATENT DOCUMENTS

| | | | |
|---|---|---|---|
| 3,089,842 | 5/1963 | Stratton | 208/44 |
| 3,135,728 | 6/1964 | Monroe | 260/85 |
| 4,104,035 | 8/1978 | Cole et al. | 44/51 |
| 4,302,212 | 11/1981 | Yamamura et al. | 44/51 |
| 4,330,301 | 5/1982 | Yamamura et al. | 44/51 |
| 4,457,762 | 7/1984 | Papalos et al. | 44/51 |
| 4,470,828 | 9/1984 | Yamamura et al. | 44/51 |
| 4,565,546 | 1/1986 | Ohzeki et al. | 44/51 |

FOREIGN PATENT DOCUMENTS

| | | | |
|---|---|---|---|
| 60-0053595 | 3/1985 | Japan | 44/51 |

*Primary Examiner*—Mark L. Bell
*Assistant Examiner*—Margaret B. Medley
*Attorney, Agent, or Firm*—Birch, Stewart, Kolasch & Birch

[57] ABSTRACT

A coal - water slurry at high concentration which has a low viscosity and favorable flowing property is prepared by using a surface active substance prepared by sulfonating and oxidizing at least one of the starting materials selected from distilled petroleum oils, petroleum pitches, asphalts, distilled coal oils, coal pitches or coals, applying condensation as required and then neutralizing the thus obtained product with alkalis.

19 Claims, No Drawings

PROCESS FOR PRODUCING COAL-WATER SLURRY AT HIGH CONCENTRATION

FIELD OF THE INVENTION AND RELATED ART STATEMENT

This invention concerns a method for preparing a surface active agent useful for obtaining a coal-water slurry at high concentration, which has a low viscosity and a favorable flowing property, as well as a satisfactory stability.

The coal-water slurry at high concentration obtained according to this invention, is extremely desirable for use as fuels.

With the recent rise of petroleum cost, inexpensive coals have now more frequently been re-evaluated as fuels. But coals, being solid, involve a significant drawback in that they are troublesome to handle.

In order to overcome such a drawback, coal-petroleum fuels prepared by mixing coal powder and petroleum (COM) have been proposed and they have been, in part, put to practical use, since about one-half or more of these fuels have to be constituted with an oil component in order to obtain a satisfactory flowing property, or they would not be economically advantageous.

In view of the above, at present coal slurries prepared by dispersing coals at a high concentration and using water as a dispersing medium have mainly been studied and it is essential that an appropriate surface active agent be used in order to increase the coal concentration and to obtain satisfactory flowing property and stability. As the surface active agent, there have been proposed anionic surface active agents such as alkyl aryl sulfonate, fatty acid soaps and polyoxyethylene alkyl(phenyl)ether sulfate and non-ionic surface active agent such as polyoxyethylene alkyl ether and polyoxyethylene(polyoxypropylene)alkylphenyl ether.

However, these surface active agents have not always been effective and usually no appropriate flowing property can be obtained having a coal concentration of higher than 65%. In addition, these surface active agents lack economical merit in view of the amount used and because of the cost. Therefore more efficient and economical surface active agents are needed.

OBJECT AND SUMMARY OF THE INVENTION

It is an object of the present invention to propose a novel surface active substance as a novel dispersant for use in a coal-water slurry at high concentration and which is highly effective and is excellent economically.

The surface active substance is prepared by sulfonating and oxidizing at least one of the starting materials selected from distilled petroleum oils, petroleum pitches, asphalts, distilled coal oils, coal pitches or coals, applying condensation as required and followed by neutralizing the thus obtained product with alkalis.

DETAILED DESCRIPTION OF PREFERRED EMBODIMENTS

The novel surface active agent for use in a coal-water slurry at high concentration employed in this invention (hereinafter referred as a surfactant of this invention) is prepared by sulfonating and oxidizing at least one hydrocarbon, having a molecular weight of greater than 170 and a H/C atomic ratio of from 0.5 to 1.7, selected from distillated petroleum oils, petroleum pitches, asphalts, distillated coal oils, coal pitches or coals, subjecting the thus obtained product to formaldehyde condensation if required and followed by neutralizing the condensate with alkalis.

The formaldehyde condensation can increase the molecular weight of the obtained surface active agent and further improve the surface active effect. Accordingly, in the case of using a hydrocarbon having a low molecular weight as the starting material, conduction of formaldehyde condensation is preferred.

It is essential for the starting material of the surfactant of this invention to have a high molecular weight and to contain a high content of an aromatic ingredient. As the starting material of this invention, while any of the various types of hydrocarbons as described above can be used solely or in admixture, use of those having a H/C atomic ratio within a range from 0.5 to 1.7 is preferred. The H/C atomic ratio of the petroleum type starting material lies generally within a range from 0.4 to 2.4. Particularly, light distillation fractions, for example, naphtha, kerosene oil and light gas oil have the H/C atomic ratio ranging from 1.7 to 2.4 and these fractions have low aromatic compound content and high alkyl side chain ratio in the molecule of the aromatic compounds. If these fractions were to be used as the starting material for the surfactant of this invention, the surface active effect is reduced due to the disconnection of linear hydrocarbons and alkyl side chains on aromatic rings accompanying the sulfonation and oxidation. Further, with those materials having a H/C atomic ratio of less than 0.5, dehydrogenating condensation accompanying the sulfonation proceeds extremely readily to reduce the reaction efficiency of oxidation to produce products with no sufficient surface active effect.

While the starting coal materials have a H/C atomic ratio ranging from 0.2 to 2.0, a main ingredient of coals represented by the H/C atomic ratio of from 1.7 to 2.0 are cycloparaffinic hydrocarbon, and accordingly, the reaction efficiency in the sulfonating and oxidizing reactions is low and fails to obtain a surfactant having a sufficient surface active effect. Further, in the case of a starting coal material having the H/C atomic ratio of less than 0.5, a sufficient amount of hydrophilic groups cannot be introduced which results in a failure to obtain an activator having a sufficient surface active effect since the degree of condensation of the aromatics is extremely high.

Accordingly, distilled oils such as naphtha, kerosene and heavy oils or asphalt residual oils obtained, for example, by usual distillation of crude oils under atmospheric or sub-atmospheric pressure are, preferably, used by subjecting them to heat decomposition to increase the aromatic ingredient by the known method, rather than using them as they are as the starting material. Depending on the case, the aromatic content may further be increased by solvent extraction or the like.

Referring to one example for a heat decomposing treatment which is suitable for obtaining the starting material of this invention, there is a method of heat decomposing of heavy oils under liquid phase at a relatively moderate decomposing temperature range of from 400° to 500° C. while blowing high steam temperature range of from 600°–700° C. and thereby obtaining cracked distillation oils and pitches enriched in the aromatic ingredient. Since most of the aromatic-enriched asphalts or petroleum pitches have the H/C ratio contained in the above-mentioned range, they can be used directly as the starting material.

The thus obtained starting material is subjected to sulfonation and oxidation and, depending on the case, to formaldehyde condensation. Usually, the reaction can be carried out efficiently when it is conducted in the order of sulfonation, oxidation and formaldehyde condensation.

Sulfonation is effected by using a known sulfonating agent such as sulfuric acid, fuming sulfuric acid and anhydrous sulfuric acid. For carrying out the reaction uniformly, it is necessary that petroleum pitch, asphalt, coal pitch and coal as the starting materials, which are solid at normal temperature, are at first finely pulverized. They are then preferably dispersed and dissolved in an aliphatic hydrocarbon, for example, tetrachloroethane, dichloroethane, trichloroethylene, perchloroethylene and trichloroethane, followed by sulfonation. As the sulfonating agent, anhydrous sulfuric acid is preferred for suppressing the side-reaction and proceeding the reaction efficiently. The oxidation is carried out by using a known oxidizing agent, for example, hydrogen peroxide, ozone, air, nitric acid and nitrogen oxide, the use of nitric acid and nitrogen oxide being preferred in view of the reaction efficiency.

After completion of the sulfonation and the oxidation, formaldehyde condensation takes place in view thereof, particularly, when a starting material of having a low molecular weight of 170 to 1000 is used. In this case, the reaction is carried out, after distilling off the solvent employed, by dissolving or dispersing, the material to be sulfonated and oxidized, in water and adding an aqueous formaldehyde solution, followed by heating. The thus obtained sulfonation and oxidation product or the formaldehyde condensates thereof are purified as required and then neutralized by known methods with alkalis, for example, sodium hydroxide, potassium hydroxide, ammonia, monoethanolamine, diethanolamine, triethanolamine and the like. Use of sodium hydroxide or ammonia is desirable from an economical point of view.

General conditions are shown below in the case of carrying out the sulfonation with anhydrous sulfuric acid and the oxidation with nitric acid or nitrogen oxide. One part by weight of the starting material used, is dispersed or dissolved, as it is in the case of liquid material after fine pulverization. In the case of using a solid material 2 to 30 parts by weight of a halogenated aliphatic hydrocarbon is used. Then, from 0.01 to 3.0 parts by weight of anhydrous sulfuric acid is at first added and sulfonation is carried out for 20–180 minutes at a reaction temperature from 15° C. to a temperature below the boiling point of the solvent. Then, 0.2–20 parts by weight of liquid or gasified nitric acid or nitrogen dioxide is introduced with or without distilling off the solvent to conduct oxidation under an atmospheric or an elevated pressure for 30 to 300 minutes of reaction time and at 50° to 150° C. of reaction temperature. Since nitrogen dioxide, when introduced in a gasified state into the reaction system, can improve the contact efficiency, it is preferred in view of the uniform oxidizing reaction.

In the case of further applying formaldehyde condensation when preparing the surfactant of this invention, the solvent is distilled off from the reaction product after the completion of the sulfonation and the oxidation. From 0.2 to 3 parts by weight of water is added for dispersion or dissolution. An aqueous formaldehyde solution is then added by such an amount as to provide from 0.2 to 1.5 formaldehyde units per one sulfonic group. The reaction is carried out under heating to 80°–150° C. under an atmospheric pressure or an elevated pressure for 2 to 20 hours while stirring.

The surfactant of this invention thus obtained contains hydrophilic groups which mainly consist of sulfonic groups and carboxylic groups in the molecule. Those used for the purpose of this invention generally contain from 0.2 to 8 meq/g (mg equivalent/g) and, more preferably, from 1 to 5 meq/g of sulfonic groups, and from 2 to 15 meq/g and, more preferably, from 4 to 10 meq/g of the total acidic groups for the neutralizing agent titrated with a solution of sodium hydroxide. It is necessary that the coals used for obtaining the coal-water slurry at high concentration by using the surfactant of this invention as the dispersant are usually pulverized finely so as to contain from 70 to 90% of 200 mesh under fractions. Any of the known methods can be applied for using the surfactant of this invention such as using the surfactant in admixture with previously powderized coal and water, or adding the surfactant before or during powderization of coal or stepwise addition during powderization. If the deashing treatment of coal is necessary, it is usually carried out before the addition of the surfactant of this invention.

While the surfactant of this invention can be applied to any quality of coal-water slurries irrespective of the yield and the quality of them, the grain size of the coal and the slurry concentration, etc. are somewhat varied for obtaining the optimum viscosity depending on the kind of coals. Usually, a stable coal-water slurry at high concentration of from 65 to 75% by weight can be obtained by using from 0.1 to 1% by weight of the surfactant of this invention. The coal-water slurry obtained according to this invention has a flowing property even at a high coal concentration, which is not only convenient in a transportation and storage, but also provides an extremely high combustion efficiency.

In this invention, the surfactant as described above can be used in combination with other known surfactants or protection colloids.

The process of this invention will now be explained with reference to the following examples. It should, however, be noted that this invention is in no way limited by the descriptions of these examples.

EXAMPLE 1

I. Synthesis of Surfactant 1 of the Invention

Mixed crude oils comprising Khafji crude oil and Iranian heavy crude oil at 1:1 volume ratio were processed in a pressure-reduced device at a pressure of 60 mmHg and a bottom temperature of 340° C. to obtain bottom residues having a (specific gravity of 1.022 (25/25° C.), softening point at 44° C., C.C.R. (residual carbon content) of 19.5 wt%, which were treated under a pressure of 2 kg/cm$^2$ and at a decomposing temperature of 430° C. using superheated steams at 600° C. for 2 hours under the heat decomposing conditions to obtain petroleum pitches having a softening point of 180° C., a volatiling content of 40% by weight, an ash content of 0.2% by weight and a H/C atomic ratio of 0.8. The petroleum pitches were hereinafter referred to as the starting material A. The pitches were pulverized into a powder of less than 100 mesh. One part by weight of the powder was sampled into an autoclave made of glass and joined with five parts by weight of tetrachloroethane and the pitch and the solvent are mixed and dispersed by rotating a stirrer at 500 rpm. 2.0 parts by weight of anhydrous sulfuric acid that had previously been evaporized by heating was introduced to effect a sulfonizing reaction at 50° C. for 60 minutes under an atmospheric pressure. Then, the temperature was increased to 120° C., 5 parts by weight of 50% nitric acid was added and oxidation was carried out for two hours. Then, after filtering, water-washing and drying the reaction product, when a portion thereof was taken to determine the sulfonic group content and the total acidic group content by the customary method, it contained 5.7 meq/g of sulfonic group and 13.1 meq/g of total acid group contents. After neutralizing the product with sodium hydroxide so as to adjust the pH value of the 1% aqueous solution to 8.0, it was dried and pulverized to obtain the surfactant 1 of this invention as black powder.

The product 1 was subjected to the test as described below.

II. Synthesis for the Surfactants 2-6, 9, 10 of the Invention

The surfactants 2-6, 9 and 10 of this invention were synthesized in the same procedures as for the surfactant 1 of this invention using the same petroleum pitches (starting material A) as the surfactant 1 of this invention as the starting material, anhydrous sulfuric acid as the sulfonizing agent, tetrachloroethane or perchloroethylene as the solvent and sulfuric acid or nitric acid as the oxidizing agent under the conditions shown in Table 1. The conditions for the synthesis and the properties of the surfactant 1 and the surfactants 2-6, 9 and 10 are shown in Table 1 below.

III. Synthesis for the Surfactants 7 and 8 of the Invention

The surfactants 7 and 8 of the invention were synthesized by using the same petroleum pitches (starting material A) as those for the surfactant 1 of the invention as the starting material and using 98% conc sulfuric acid or 60% fuming sulfuric acid as the sulfonizing agent. The sulfonizing reaction was carried out, without using the chlorine type hydrocarbon solvent but under the sulfonizing conditions shown in Table 1, in which the pitches were previously mixed with concentrated sulfuric acid or fuming sulfuric acid in a mortar sufficiently and they were transferred to a glass autoclave and reacted while rotating the stirrer at 100 rpm at 40° C. for 60 min. Then, one parts by weight of the thus obtained sulfonization product was sampled into a glass autoclave and synthesized under the oxidizing condition shown in Table 1 to obtain materials having properties shown in Table 1.

IV. Synthesis for Surfactants 11-13 of the Invention

High coaking coal yielded in North American district were subjected to dry-distillation and distilled coal tars were subjected under the same heat decomposing conditions as those for the starting material of the surfactant 1 of the invention. Then, the surfactants 11-13 having the properties as shown in Table 1were synthesized in the same manner as the surfactant 1 of the invention by using the thus obtained coal tar pitches (starting material B) having a softening point of 180° C., a volatiling component of 37.5% by weight and a H/C atomic ratio of 0.79 as the starting material and under the conditions shown in Table 1.

V. Synthesis for Surfactants 14, 15 of the Invention

Deashed bituminous coal yield in North American district having a water content of 2.8% by weight, an ash content of 0.9% by weight, a volatiling component of 14.5% by weight and a fixed carbon content of 63.0% by weight were used as the starting material starting material C) and the surfactants 14, 15 of the invention having the properties as shown in Table 1 were synthesized in the same manner as the surfactant 1 of the invention.

VI. Synthesis for the Surfactants 16-18 of the Invention

Mixed crude oils comprising South America Bachaquero crude oils, Middle East Khafji crude oils, Iranian heavy crude oil, Isthumus crude oil in 4:2:1:1 volume ratio were processed in a pressure-reduced distillation device under a pressure of 70 mmHg and at a bottom temperature of 335° C. The surfactants 16-18 of the invention were synthesized by using bottom oils (asphalt) thus prepared having a specific gravity (25/25° C.) of 1.0115, a softening point of 38.5° C., C.C.R. (residual carbon content) of 16.9 wt% and a H/C atomic ratio of 1.45 as the starting material. After dissolving them at 50° C. for five minutes in tetrachloroethane, they were synthesized in the same manner as the activator 1 of the invention under the conditions shown in Table 1 to obtain the surfactants 16-18 having the properties shown in Table 1.

VII. Synthesis for Surfactants 19-22 of the Invention

The surfactants 19-22 of the invention were obtained by using a mixture of the starting material for the surfactant 1 of the invention and the starting material for the surfactants 11-13 of the invention in 1:1 weight ratio (starting material E) having a softening point of 148° C., a volatiling component of 39.1% by weight and a H/C atomic ratio of 0.8 under the same conditions shown in Table 1 to obtain surfactants 19-22 having the properties shown in Table 1.

TABLE 1

| | Synthesis of Surfactants (2)-(22) of the Invention | | | | | Property of the Synthesized Product | | | |
|---|---|---|---|---|---|---|---|---|---|
| Surfactant No. | Starting Material | Sulfonating Agent/ Starting Material Weight Ratio | Nitric Acid/ Starting Material Weight Ratio | Solvent | Neutralizing Agent | Appearance (dry) | Sulfonic Group meq/g | Total Acidic Group meq/g | 1% Solution pH |
| 2 | Material A | Anhydrous sulfuric acid 1/0.1 | 50% 1/5.0 | Tetrachloroethane | Sodium hydroxide | Black powder | 2.8 | 6.1 | 8.1 |
| 3 | Material A | Anhydrous sulfuric acid 1/0.1 | 50% 1/5.0 | Perchloroethylene | Sodium hydroxide | Black powder | 2.7 | 6.0 | 8.0 |
| 4 | Material A | Anhydrous sulfuric acid 1/0.2 | 50% 1/5.0 | Perchloroethylene | Ammonia | Black powder | 3.8 | 7.2 | 7.5 |
| 5 | Material A | Anhydrous sulfuric acid 1/0.5 | 61% 1/6.0 | Tetrachloroethane | Sodium hydroxide | Black powder | 4.0 | 8.5 | 8.4 |

TABLE 1-continued

| Surfactant No. | Starting Material | Sulfonating Agent/ Starting Material Weight Ratio | Nitric Acid/ Starting Material Weight Ratio | Solvent | Neutralizing Agent | Appearance (dry) | Sulfonic Group meq/g | Total Acidic Group meq/g | 1% Solution pH |
|---|---|---|---|---|---|---|---|---|---|
| | | Synthesis of Surfactants (2)-(22) of the Invention | | | | Property of the Synthesized Product | | | |
| 6 | Material A | 98% Conc. sulfuric acid 1/0.5 | 61% 1/6.0 | Tetrachloroethane | Sodium hydroxide | Black powder | 2.9 | 7.2 | 8.1 |
| 7 | Material A | 98% Conc. sulfuric acid 1/1.0 | 61% 1/6.0 | None | Sodium hydroxide | Black powder | 3.7 | 8.3 | 8.0 |
| 8 | Material A | 60% Fuming sulfuric acid 1/1.0 | 61% 1/6.0 | None | Sodium hydroxide | Black powder | 3.9 | 8.5 | 8.4 |
| 9 | Material A | Anhydrous sulfuric acid 1/1.0 | 50% 1/4.0 | Tetrachloroethane | Sodium hydroxide | Black powder | 4.6 | 9.8 | 8.5 |
| 10 | Material A | Anhydrous sulfuric acid 1/2.5 | 50% 1/3.0 | Tetrachloroethane | Sodium hydroxide | Black powder | 5.7 | 12.3 | 8.5 |
| 11 | Material B | Anhydrous sulfuric acid 1/0.1 | 50% 1/5.0 | Tetrachloroethane | Sodium hydroxide | Black powder | 2.5 | 7.1 | 8.2 |
| 12 | Material B | Anhydrous sulfuric acid 1/0.5 | 50% 1/4.0 | Tetrachloroethane | Sodium hydroxide | Black powder | 3.4 | 8.6 | 8.3 |
| 13 | Material B | Anhydrous sulfuric acid 1/1.5 | 50% 1/4.0 | Trichloroethylene | Sodium hydroxide | Black powder | 4.7 | 13.1 | 8.1 |
| 14 | Material C | 98% Conc. sulfuric acid 1/0.5 | 50% 1/5.0 | Tetrachloroethane | Sodium hydroxide | Black powder | 2.7 | 7.4 | 8.0 |
| 15 | Material C | Anhydrous sulfuric acid 1/1.5 | 50% 1/4.0 | Tetrachloroethane | Monoethanol amine | Black powder | 5.1 | 10.3 | 7.4 |
| 16 | Material D | Anhydrous sulfuric acid 1/0.3 | 61% 1/6.0 | Tetrachloroethane | Ammonia | Brown powder | 3.9 | 7.1 | 7.4 |
| 17 | Material D | Anhydrous sulfuric acid 1/1.0 | 61% 1/3.5 | Tetrachloroethane | Ammonia | Brown powder | 4.7 | 9.9 | 7.6 |
| 18 | Material D | 60% Fuming sulfuric acid 1/2.5 | 61% 1/4.0 | Tetrachloroethane | Sodium hydroxide | Brown powder | 4.8 | 8.8 | 8.6 |
| 19 | Material E | Anhydrous sulfuric acid 1/0.1 | 61% 1/5.0 | Tetrachloroethane | Sodium hydroxide | Black powder | 2.1 | 6.4 | 8.1 |
| 20 | Material E | Anhydrous sulfuric acid 1/0.7 | 50% 1/5.0 | Tetrachloroethane | Potassium hydroxide | Black powder | 4.3 | 8.1 | 8.0 |
| 21 | Material E | Anhydrous sulfuric acid 1/2.5 | 50% 1/3.0 | Tetrachloroethane | Sodium hydroxide | Black powder | 6.1 | 13.4 | 8.4 |
| 22 | Material E | Anhydrous sulfuric acid 1/3.5 | 50% 1/3.0 | Tetrachloroethane | Sodium hydroxide | Black powder | 7.9 | 15.0 | 8.2 |

VIII. Synthesis for the Surfactant 23 of the Invention

Mixed crude oils composed of Bachaquero crude oils, Arabian light crude oils, and Arabian heavy crude oils in 5:2:1 volume ratio were distilled under the same conditions as those for the starting material A in the synthesis of the surfactant 1 to obtain bottom oils having a specific gravity (25/25° C.) of 1.0310, a softening point of 47.5° C. and C.C.R. (residual carbon content) of 21.4% by weight were treated under the same heat decomposing conditions as those for the starting material A, and the thus obtained petroleum pitches (starting material F) having a softening point of 220° C., a volatiling component of 32% by weight, an ash content of 0.2% by weight and a H/C atomic ratio of 0.68 were used as the starting material. The pitches were pulverized into powder of smaller than 100 mesh and one part thereof was sampled into a glass autoclave, which were dissolved and dispersed by the addition of 10 parts by weight of tetrachloroethylene at 110° C. for 30 minutes while stirring at 500 rpm. Then, they were cooled to 15° C. and 1.5 parts by weight of gasified anhydrous sulfuric acid was introduced to carry out a sulfonizing reaction for one hour.

Then, the temperature was elevated to 130° C. and an oxidizing treatment was carried out by introducing 2.0 parts by weight of gaseous nitrogen oxide for two hours. After filtering, water-washing and the drying the reaction product, sulfonic content and the total acidic group content were measured for a portion thereof in a customary manner to be 5.0 meq/g of sulfonic group and 11.8 meq/g of total acidic group. The product was neutralized with sodium hydroxide so as to adjust the pH of the 1% aqueous solution to 8.0, followed by drying and pulverization to obtain the surfactant 23 of the invention as black powder.

IX. Synthesis for the surfactant 24 of the Invention

Oils comprising desulfurized and pressure-reduced gas oils and heavy gas oils at a 4:1 volume ratio were processed in a fluid catalytic cracker (reaction temperature at 530° C. using zeolite catalyst) to prepare a cracked bottom oils having a specific gravity (15/4° C.) of 1.0971, a boiling point from 200° C. to 538° C.+, a H/C atomic ratio of 0.96 and an average molecular weight of 300 (starting material G) which were used as the starting material. One part by weight of the starting material was collected in a glass autoclave, to which five parts by weight of tetrachloroethane was added and 1.0 parts by weight of gasified anhydrous sulfuric acid was introduced at 15° C. while stirring at 500 rpm to conduct sulfonization for one hour. Then, the temperature was elevated to 120° C. and 2 parts by weight of gaseous nitrogen dioxide was introduced for two hours for carrying out oxidizing treatment.

After filtering the reaction product, when the sulfonic group content and the total acidic group content for a portion thereof were measured by a customary method, the sulfonic group was 4.2 meq/g and the total acidic group was 6.8 meq/g. Then, the reaction product was neutralized with sodium hydroxide so as to adjust the pH value of an 1% aqueous solution to 8.0, followed by dehydration and pulverization to obtain the surfactant 24 of black powder.

X. Synthesis for the Surfactant 25 of the Invention

One part by weight of the thermal cracked oils having a boiling point from 400° to 538° C.+ fraction, a specific gravity (15/4° C.) of 0.9810, a H/C atomic ratio of 1.47 and an average molecular weight of 500 (starting material H). The material was sampled by one part by weight in a glass autoclave, together with five parts by weight of tetrachloroethane and 1.0 parts by weight of gasified anhydrous sulfuric acid at 30° C. while stirring at 500 rpm to conduct sulfonizing treatment for one hour. Then, the temperature was elevated to 120° C. and an oxidizing treatment was carried out by introducing gaseous nitrogen dioxide by 1.0 parts by weight for one hour. The reaction product was filtered out and the sulfonic group content and the total acidic content were determined for a portion thereof by an ordinary method to be 3.9 meq/g of sulfonic group and 7.1 meq/g of total acidic group. The reaction produce was neutralized with sodium hydroxide so as to adjust the pH value of an aqueous 1% solution to 8.0 followed by dehydration and pulverization to obtain the surfactant 25 of black powder.

XI. Synthesis for Surfactant 26 of the Invention

Acidic type surfactant 9 of the invention synthesized by the surfactant 9 of the invention was introduced by one part by weight into a glass autoclave and dispersed in 2 parts of purified water. Then, 0.3 parts by weight of 96% conc. sulfuric acid and 0.3 parts by weight of 37° C. formaldehyde were added at 90° C. for 2 hours while stirring at 500 rpm and maintained at 100° C. for 7 hours to carry out the condensation reaction.

After the completion of the reaction, the reaction product was washed with water and neutralized with sodium hydroxide so as to adjust the pH value of an 1% aqueous solution to 8.0, followed by drying and pulverization to obtain a surfactant 26 of the invention of black powder. The intrinsic viscosity $\eta$ of the thus obtained surfactant 26 and the surfactant 9 were determined as 9=0.125, 25=0.510 to find that formaldehyde condensation was proceeded.

XII. Synthesis for Surfactants 27-30 of the Invention

The surfactants 27-30 of the invention of the formaldehyde condensation type were synthesized in the same manner as in the synthesize of the surfactant 26 of the invention. While the reaction temperature and the time for the formaldehyde condensation were quite the same as in the case of the surfactant 26, other conditions are as shown in Table 2.

TABLE 2

| | | Synthesis for Surfactants (27)-(30) of the Invention | | Property of the Synthetic Product | |
|---|---|---|---|---|---|
| Surfactant No. | Starting Material | Starting Material: 35% Formaldehyde Weight Ratio | Neutralizing Agent | Appearance (dry) | 1% Solution pH |
| 27 | Acid type for 21 | 1:0.5 | Sodium hydroxide | Black powder | 8.2 |
| 28 | Acid type for 22 | 1:0.6 | Potassium hydroxide | Black powder | 8.4 |
| 29 | Acid type for 24 | 1:0.5 | Ammonia | Black powder | 7.7 |
| 30 | Acid type for 25 | 1:0.6 | Sodium hydroxide | Black powder | 8.2 |

XIII. Production of Coal-Water Slurry According to the Invention

Wallarah coal containing 2.8% water content, 13.5% ash, 24.6% volatizable component and 56.5% fixed carbon were pulverized in a pin mill and then treated in an attritor in the form of aqueous 50% dispersion for 30 minutes to obtain a coal slurry with the grain size of 82% of 200 mesh pass fraction.

Then, the slurry was heated and the water content was evaporated to obtain 80% by weight of a solid content. Each 0.4 g of the surfactants 1-30 of the invention and water were added to 100 g of the product to adjust the coal concentration to 68% by weight and they were stirred for 10 min. in a homogenizing mixer to obtain a coal slurry at high concentration. If the flowing property could not be obtained at this concentration, water was added till a desired flowing property could be attained. The results for measurement of the viscosity for the thus obtained slurry by a rotary viscometer were as shown in the following Table 3. The viscosity indicated in the table was determined at 20° C., using rotor No. 13, at 12 rpm.

When the slurries of specimen Nos. 3, 6, 7, 10, 12, 14, 15, 17, 18, 20, 22, 24, 26 and 30 were stored at a room temperature for 6 month in a 100 cc mayonnaise bottle and the absence or presence of precipitation was investigated at the bottom of the bottle by the penetration of a glass rod, no settling was recognized substantially in any of the cases.

The comparative surfactants used in this test had the following contents and the addition amount of the comparative surfactants was 0.4 g based on 100 g of the coal slurry.

Comparative surfactant 1: Sodium poly(10)oxyethylene lauryl ether sulfate

Comparative surfactant 2: poly(20)oxyethylene nonylphenyl ether

Comparative surfactant 3: poly(15)oxyethylenepoly(15)oxypropylene octyl phenyl ether Comparative surfactant 4: Arabian light crude oils were distilled under an atmospheric pressure to obtain distillation fractions having a boiling point of 230°-330° C., a specific gravity (15/4° C.) of 0.8435, a H/C atomic ratio of 1.79 and an average molecular weight of 180. One part by weight of the starting material was sampled in a glass autoclave and dissolved into 2 parts by weight of tetrachloroethylene, to which 0.3 parts by weight of gasified anhydrous sulfuric acid was introduced at a temperature of 20° C. while stirring at 500 rpm to conduct sulfonization for one hour. Then, the temperature was elevated to 120° C. and oxidizing treatment was carried out by introducing 2 parts by weight of gaseous nitrogen dioxide for 2 hours.

Then, after filtering the tetrachloroethylene in which unreacted oils were dissolved and tar-like product, the sulfonic group content and the total acidic group content for a portion thereof were determined by a customary method to find that the sulfonic group was 2.1 meq/g and the total acidic group was 5.1 meq/g.

The product was neutralized with sodium hydroxide so as to adjust the pH of 1% aqueous solution to 8.0 and then concentrated to 50% concentration of the aqueous solution, to obtain the comparative surfactant 4 of a pale yellow liquid.

Comparative surfactant 5: The straight naphtha fraction from Middle East mixed crude oils boiling at 80°-160° C. was hydrogenated in a pre-treating device and further modified with platinum type bimetal catalyat to obtain oils having a specific gravity (15/4° C.) of 0.7883, a boiling point from 50° to 200° C., a H/C atomic ratio of 1.48 and an average molecular weight of 100 as the starting material. Then, one part of the starting material was sampled in a glass autoclave together with 2 parts by weight of tetrachloroethylene, to which 0.5 parts by weight of gasified anhydrous sulfuric acid was added at a temperature of 15° C. under stirring at 500 rpm to carry out sulfonization for one hour. Then, the temperature was elevated to 50° C. and oxidization was carried out by introducing 2 parts by weight of gaseous nitrogen dioxide for three hours.

After the completion of the reaction, the content was cooled to a room temperature and unreacted oil-containing tetrachloroethylene and tar-like product were separated by filtration and the sulfonic group content and the total acidic group content were measured for a portion thereof by a customary method, to find that the sulfonic group was 5.0 meq/g and the total acidic group was 7.3 meq/g. The product was neutralized with sodium hydroxide so as to adjust the pH of the 1% aqueous solution to 8.0 and then concentrated to 50% aqueous solution concentration to obtain a comparative surfactant 5 of pale yellow liquid.

Comparative surfactant 6: One part by weight of comparative surfactant 5 not neutralized with alkaline was sampled into a glass autoclave and dispersed into 2 parts by weight of purified water, to which 0.3 parts by weight of concentrated sulfuric acid 98% was added and one part by weight of 37% formaldehyde was added at 90° C. for about three hours under stirring at 500 rpm. Then, they were maintained at 100±2° C. for 7 hours to conduct condensating reaction. After the completion of the reaction, the reaction product was filtered, washed with water and neutralized with sodium chloride so as to adjust the pH of 1% aqueous solution to 8.0, followed by dehydration and pulverization to obtain a comparative surfactant 6 of yellow powder.

The properties of the coal-water slurry prepared by adding the surfactant according to this invention as the dispersant and the properties of the coal-water slurry prepared by adding the comparative surfactants as the dispersant are shown in Table 3.

TABLE 3

| Specimen No. | Properties of Coal - Water Slurry: Surfactant | Coal Concentration | Viscosity (C.P.S.) |
|---|---|---|---|
| 1 | No addition | 68% | No fluidity |
| 2 | No addition | 53% | 1350 |

TABLE 3-continued

| Specimen No. | Properties of Coal - Water Slurry: Surfactant | Coal Concentration | Viscosity (C.P.S.) |
|---|---|---|---|
| 3 | Surfactant of the invention (1) | 68% | 980 |
| 4 | Surfactant of the invention (2) | 68% | 1650 |
| 5 | Surfactant of the invention (3) | 68% | 1540 |
| 6 | Surfactant of the invention (4) | 68% | 1310 |
| 7 | Surfactant of the invention (5) | 68% | 1150 |
| 8 | Surfactant of the invention (6) | 68% | 970 |
| 9 | Surfactant of the invention (7) | 68% | 860 |
| 10 | Surfactant of the invention (8) | 68% | 720 |
| 11 | Surfactant of the invention (9) | 68% | 650 |
| 12 | Surfactant of the invention (10) | 68% | 740 |
| 13 | Surfactant of the invention (11) | 68% | 1670 |
| 14 | Surfactant of the invention (12) | 68% | 1850 |
| 15 | Surfactant of the invention (13) | 68% | 940 |
| 16 | Surfactant of the invention (14) | 68% | 1360 |
| 17 | Surfactant of the invention (15) | 68% | 1020 |
| 18 | Surfactant of the invention (16) | 68% | 1170 |
| 19 | Surfactant of the invention (17) | 68% | 840 |
| 20 | Surfactant of the invention (18) | 68% | 720 |
| 21 | Surfactant of the invention (19) | 68% | 2010 |
| 22 | Surfactant of the invention (20) | 68% | 1470 |
| 23 | Surfactant of the invention (21) | 68% | 920 |
| 24 | Surfactant of the invention (22) | 68% | 730 |
| 25 | Surfactant of the invention (23) | 68% | 2640 |
| 26 | Surfactant of the invention (24) | 68% | 1780 |
| 27 | Surfactant of the invention (25) | 68% | 520 |
| 28 | Surfactant of the invention (26) | 68% | 700 |
| 29 | Surfactant of the invention (27) | 68% | 810 |
| 30 | Surfactant of the invention (28) | 68% | 740 |
| 31 | Surfactant of the invention (29) | 68% | 720 |
| 32 | Surfactant of the invention (30) | 68% | 770 |
| 33 | Comparative surfactant (1) | 68% | No fluidity |
| 34 | Comparative surfactant (1) | 61% | 2420 |
| 35 | Comparative surfactant (2) | 68% | No fluidity |
| 36 | Comparative surfactant (2) | 59% | 1140 |
| 37 | Comparative surfactant (3) | 68% | No fluidity |
| 38 | Comparative surfactant (3) | 62% | 980 |
| 39 | Comparative surfactant (4) | 68% | No fluidity |
| 40 | Comparative surfactant (4) | 61% | 870 |
| 41 | Comparative surfactant (5) | 68% | No fluidity |

TABLE 3-continued

| Specimen No. | Surfactant | Coal Concentration | Viscosity (C.P.S.) |
|---|---|---|---|
| | Properties of Coal - Water Slurry | | |
| 42 | Comparative surfactant (5) | 61% | 920 |
| 43 | Comparative surfactant (6) | 68% | No fluidity |
| 44 | Comparative surfactant (6) | 62% | 1110 |

Any of the surfactants according to this invention had a viscosity of less than 3000 cps at the coal concentration of 68% and showed more excellent dispersing effect as compared with the comparative surfactants.

EXAMPLE 2

Coal-water slurries at high concentration were prepared by using the surfactants 1–30 of the invention used in Example 1 and the comparative surfactant, and the viscosity thereof was measured.

Coals yielded in Western district of United States having a water content of 3.6%, an ash content of 14.1%, a volatiling content of 21.5% and a fixed carbon of 58.1% were pulverized in pin mill and then treated in an attritor for 30 minutes in the form of an aqueous 50% dispersion to obtain a coal slurry at a viscosity of 78% 200 mesh pass.

Then, the slurry was deashed by a specific gravity separation method to reduce the ash content to 2.1% and then water was evaporated by heating to increase the solid content to 80% by weight. Then, 100 g of the product, 0.5 g of the surfactant and water were added to 71% by weight of coal concentration, treated in an attritor for 5 minutes and the viscosity of the thus obtained slurry was measured by the rotational viscometer, the results of which are as shown in Table 4. The viscosity in the table was measured at 20° C. by using a rotor No. 3 at 12 rpm. The specimens No. 2, 4, 6, 8, 9, 11, 13, 16, 19, 20, 21, 23, 25, 28 and 29 were placed in a bottle of 1000 cc volume stored under a room temperature for 6 months and a glass rod was penetrated therethrough to examine the absence or presence of the precipitations at the bottom. No substantial precipitations were obtained in any of the cases.

While the surfactant of the invention showed a good flowing property with the viscosity of less than 3500 cps at a coal concentration 71%, none of the comparative surfactants showed fluidity.

TABLE 4

| Specimen No. | Surfactant | Coal-Concentration | Viscosity (C.P.S.) |
|---|---|---|---|
| | Property of Coal - Water Slurry | | |
| 1 | No addition | 71% | No fluidity |
| 2 | Surfactant of the invention (1) | 71% | 1760 |
| 3 | Surfactant of the invention (2) | 71% | 1650 |
| 4 | Surfactant of the invention (3) | 71% | 1340 |
| 5 | Surfactant of the invention (4) | 71% | 990 |
| 6 | Surfactant of the invention (5) | 71% | 870 |
| 7 | Surfactant of the invention (6) | 71% | 940 |
| 8 | Surfactant of the invention (7) | 71% | 740 |
| 9 | Surfactant of the invention (8) | 71% | 780 |

TABLE 4-continued

| Specimen No. | Surfactant | Coal-Concentration | Viscosity (C.P.S.) |
|---|---|---|---|
| | Property of Coal - Water Slurry | | |
| 10 | Surfactant of the invention (9) | 71% | 630 |
| 11 | Surfactant of the invention (10) | 71% | 3050 |
| 12 | Surfactant of the invention (11) | 71% | 2400 |
| 13 | Surfactant of the invention (12) | 71% | 2200 |
| 14 | Surfactant of the invention (13) | 71% | 1450 |
| 15 | Surfactant of the invention (14) | 71% | 1120 |
| 16 | Surfactant of the invention (15) | 71% | 1040 |
| 17 | Surfactant of the invention (16) | 71% | 980 |
| 18 | Surfactant of the invention (17) | 71% | 940 |
| 19 | Surfactant of the invention (18) | 71% | 3250 |
| 20 | Surfactant of the invention (19) | 71% | 3050 |
| 21 | Surfactant of the invention (20) | 71% | 2740 |
| 22 | Surfactant of the invention (21) | 71% | 2010 |
| 23 | Surfactant of the invention (22) | 71% | 2620 |
| 24 | Surfactant of the invention (23) | 71% | 1060 |
| 25 | Surfactant of the invention (24) | 71% | 1080 |
| 26 | Surfactant of the invention (25) | 71% | 860 |
| 27 | Surfactant of the invention (26) | 71% | 780 |
| 28 | Surfactant of the invention (27) | 71% | 910 |
| 29 | Surfactant of the invention (28) | 71% | 790 |
| 30 | Surfactant of the invention (29) | 71% | 930 |
| 31 | Surfactant of the invention (30) | 71% | 870 |
| 32 | Comparative Surfactant (1) | 71% | No fluidity |
| 33 | Comparative Surfactant (2) | 71% | " |
| 34 | Comparative Surfactant (3) | 71% | " |
| 35 | Comparative Surfactant (4) | 71% | " |
| 36 | Comparative Surfactant (5) | 71% | " |
| 37 | Comparative Surfactant (6) | 71% | " |

As apparent from the foregoing descriptions for the examples, the coal-water slurry obtained according to this invention can be formed at a higher concentration than that obtained by using the conventional dispersant, excellent in the fluidity and stability even at a high concentration of 71% by weight, being capable of long time storage and optional pump transportation, thus being extremely suitable to the industrial use. The coal-water slurry according to this invention can be burnt directly as the fuel with good combustion efficiency due to its high concentration thus providing an economical merit.

Further, the dispersant for use in this invention is a surface active agent starting from the hydrocarbon of a specific ingredient, and can efficiently be obtained by a novel production process, and can be produced at an extremely low cost as compared with the surface active agent utilized so far.

What is claimed is:

1. A process for producing a coal-water slurry having a high coal concentration, a low viscosity and a satisfactory flowing property and stability, comprising admixing a dispersant with a coal-water mixture to form the coal-water slurry, wherein said dispersant is an alkali neutralized surface active agent prepared by the sulfonation and followed by the subsequent oxidation of at least one hydrocarbon, having a molecular weight of greater than 170 and a H/C atomic ratio of from 0.5 to 1.7, selected from distilled petroleum oils, petroleum pitches, asphalts, distilled coal oils, coal pitches or coals, to form a hydrocarbon product containing hydrophilic groups comprising mainly of sulfonic groups and carboxylic groups, wherein the amount of sulfonic groups comprised in the formed hydrocarbon product is from 0.2 to 8 meq/g and the amount of total acidic groups comprised in the formed hydrocarbon product is from 2 to 15 meq/g, and neutralizing the formed hydrocarbon product with an alkali to produce the alkali neutralized surface agent.

2. The process of claim 1, wherein the hydrocarbon is a petroleum pitch having a molecular weight of greater than 170 and a H/C atomic ratio of from 0.7 to 1.0.

3. The process of claim 1, wherein the sulfonation and the oxidation is carried out after finely pulverizing the hydrocarbon, in which said hydrocarbon is selected from petroleum pitch, asphalt, coal pitch or coal.

4. The process of claim 1, wherein said sulfonation is carried out with an anhydrous sulfuric acid sulfonation agent using a solvent which comprises an aliphatic hydrocarbon halide.

5. The process of claim 1, wherein the oxidation is carried out subsequent to the sulfonation, and further wherein said oxidation is carried out with nitrogen oxide.

6. The process of claim 1, wherein the concentration of the coal is from 65 to 75% by weight and the dispersant is admixed in an amount of 0.1 to 1% by weight.

7. The process of claim 1, wherein the sulfonation is effected by a sulfonating agent selected from sulfuric acid, fuming sulfuric acid or anhydrous sulfuric acid.

8. The process of claim 1, wherein the oxidation is effected by an oxidation agent selected from hydrogen peroxide, ozone, air, nitric acid or nitrogen oxide.

9. The process of claim 1, wherein the neutralization is effected by a neutralization agent selected from sodium hydroxide, potassium hydroxide, ammonia, monoethanolamine, diethanolamine or triethanolamine.

10. A process for producing a coal-water slurry having a high coal concentration, a low viscosity and a satisfactory flowing property and stability, comprising admixing a dispersant with a coal-water mixture to form the coal-water slurry, wherein said dispersant is an alkali neutralized surface active agent prepared by the sulfonation and followed by the subsequent oxidation of at least one hydrocarbon, having a molecular weight of greater than 170 and a H/C atomic ratio of from 0.5 to 1.7, selected from distilled petroleum oils, petroleum pitches, asphalts, distilled coal oils, coal pitches or coals to form a hydrocarbon product containing hydrophilic groups comprising mainly of sulfonic groups and carboxylic groups, wherein the amount of sulfonic groups comprised in the formed hydrocarbon product is from 0.2 to 8 meq/g and the amount of total acidic groups comprised in the formed hydrocarbon is from 2 to 15 meq/g, subjecting the formed hydrocarbon product to formaldehyde condensation to form a condensate, and neutralizing the condensate with an alkali to form the alkali neutralized surface active agent.

11. The process of claim 10, wherein the hydrocarbon is a distilled petroleum oil having a molecular weight of greater than 170 and a H/C atomic ratio of from 0.9 to 1.5.

12. The process of claim 10, wherein the sulfonation and the oxidation is carried out after finely pulverizing the hydrocarbon, in which said hydrocarbon is selected from petroleum pitch, asphalt, coal pitch or coal.

13. The process of claim 10, wherein said sulfonation is carried out with an anhydrous sulfuric acid sulfonation agent using a solvent which comprises an aliphatic hydrocarbon halide.

14. The process of claim 10, wherein the oxidation is carried out subsequent to the sulfonation, and further wherein said oxidation is carried out with a nitrogen oxide oxidation agent.

15. The process of claim 10, wherein the concentration of the coal is from 65 to 75% by weight and the dispersant is admixed in an amount of 0.1 to 1% by weight.

16. The process of claim 10, wherein the formaldehyde condensation comprises adding an amount which provides 0.2 to 1.5 formaldehyde units per one sulfonic group.

17. The process of claim 10, wherein the sulfonation is effected by a sulfonating agent selected from sulfuric acid, fuming sulfuric acid or anhydrous sulfuric acid.

18. The process of claim 10, wherein the oxidation is effected by an oxidation agent selected from hydrogen peroxide, ozone, air, nitric acid or nitrogen oxide.

19. The process of claim 10, wherein the neutralization is effected by a neutralization agent selected from sodium hydroxide, potassium hydroxide, ammonia, monoethanolamine, diethanolamine or triethanolamine.

* * * * *